US009677575B2

(12) United States Patent
Hilzendegen et al.

(10) Patent No.: US 9,677,575 B2
(45) Date of Patent: Jun. 13, 2017

(54) VALVE FOR VALVE ASSEMBLY

(71) Applicant: Hydac Fluidtechnik GmbH, Sulzbach/Saar (DE)

(72) Inventors: Philipp Hilzendegen, Weiskirchen (DE); Peter Bruck, Althornbach (DE); Dominique Dehlinger, Sarreinsming (FR)

(73) Assignee: HYDAC FLUIDTECHNIK GMBH, Sulzbach/Saar (DE)

( * ) Notice: Subject to any disclaimer, the term of this patent is extended or adjusted under 35 U.S.C. 154(b) by 294 days.

(21) Appl. No.: 13/261,975

(22) PCT Filed: May 15, 2013

(86) PCT No.: PCT/EP2013/001438
§ 371 (c)(1),
(2) Date: Oct. 17, 2014

(87) PCT Pub. No.: WO2013/174489
PCT Pub. Date: Nov. 28, 2013

(65) Prior Publication Data

US 2015/0107699 A1 Apr. 23, 2015

(30) Foreign Application Priority Data

May 25, 2012 (DE) ..... 10 2012 010 522

(51) Int. Cl.
*F15B 11/16* (2006.01)
*F15B 11/042* (2006.01)
(Continued)

(52) U.S. Cl.
CPC ..... *F15B 11/166* (2013.01); *F15B 11/0423* (2013.01); *F15B 13/024* (2013.01);
(Continued)

(58) Field of Classification Search
CPC .. F15B 2211/20538; F15B 2211/30535; F15B 2211/3054; F15B 2211/30595;
(Continued)

(56) References Cited

U.S. PATENT DOCUMENTS 4,936,877 A * 6/1990 Hultquist ..... B01D 53/22 95/12
5,350,152 A * 9/1994 Hutchison ..... F15B 13/043 137/625.64
(Continued)

FOREIGN PATENT DOCUMENTS

EP 0 361 613 A1 4/1990
WO WO 2011/045063 A1 4/2011

*Primary Examiner* — William McCalister
(74) *Attorney, Agent, or Firm* — Wenderoth, Lind & Ponack, L.L.P.

(57) ABSTRACT

A valve (18), for a valve assembly (10) for regulating the pressure of a fluid guided in a hydraulic system for supplying pressure to at least one hydraulic consumer (12*a*, 12*b*), includes a pilot control stage (48) and a main control stage (38) for at least partially clearing or blocking a fluid path from a supply connection (P) to an outflow connection (T). A relief stage (54) for pressure relief of a fluid chamber is arranged between the pilot control stage (48) and the main control stage (38). The relief stage (54) compares the existing load pressure at load terminal (LS) dedicated to the hydraulic consumer (12*a*, 12*b*) with the outflow pressure at the outflow connection (T), clearing the pressure relief if both pressures are approximately the same. The relief stage (54) can be directly connected to the load connection (LS) and can be charged with load pressure.

22 Claims, 4 Drawing Sheets

(51) Int. Cl.
*F15B 13/02* (2006.01)
*F15B 13/06* (2006.01)
*F15B 13/00* (2006.01)

(52) U.S. Cl.
CPC ..... *F15B 13/06* (2013.01); *F15B 2013/004* (2013.01); *F15B 2211/20538* (2013.01); *F15B 2211/3054* (2013.01); *F15B 2211/30535* (2013.01); *F15B 2211/30595* (2013.01); *F15B 2211/50527* (2013.01); *F15B 2211/50536* (2013.01); *F15B 2211/6052* (2013.01); *F15B 2211/6057* (2013.01); *F15B 2211/7058* (2013.01); *Y10T 137/2589* (2015.04); *Y10T 137/777* (2015.04)

(58) Field of Classification Search
CPC .. F15B 2211/50527; F15B 2211/50536; F15B 2211/6052; F15B 2211/6057; F15B 2211/7058; F15B 11/0423; F15B 11/166; F15B 13/024; F15B 13/06; F15B 2013/004; G05D 16/10; G05D 16/103; G05D 16/106; G05D 16/166; G05D 16/18; Y10T 137/7764; Y10T 137/7766; Y10T 137/7769; Y10T 137/777
USPC ..... 137/489, 491, 492, 492.5
See application file for complete search history.

(56) References Cited

U.S. PATENT DOCUMENTS 5,445,188 A * 8/1995 Bourkel ..... F15B 13/0402 137/625.63
5,496,100 A * 3/1996 Schmid ..... B60T 15/028 251/129.19
5,639,061 A * 6/1997 Krauter ..... B60T 8/363 251/129.19
5,673,980 A * 10/1997 Schwarz ..... B60T 8/365 137/599.16
5,950,675 A * 9/1999 Minami ..... F17D 1/04 118/715
6,041,817 A * 3/2000 Guertin ..... F16K 51/02 137/565.23
6,073,652 A * 6/2000 Wilke ..... F15B 11/003 137/596.16
6,303,501 B1 * 10/2001 Chen ..... C23C 16/08 137/3
6,316,045 B1 * 11/2001 Bernard ..... C23C 16/4412 118/663
6,402,479 B1 * 6/2002 Lagedamont ..... C23C 14/564 417/201
6,419,455 B1 * 7/2002 Rousseau ..... F04B 49/065 417/2
6,619,615 B1 * 9/2003 Mayr ..... H01F 7/13 251/129.02
6,711,956 B2 * 3/2004 Lin ..... G05D 16/2013 137/487.5
6,786,132 B2 * 9/2004 Albert ..... B66F 9/22 60/406
6,904,937 B2 * 6/2005 Fischer ..... F01L 1/34 137/625.64
6,916,397 B2 * 7/2005 Pfeiffer ..... H01L 21/67253 118/719
7,040,215 B2 * 5/2006 Bruck ..... B66F 9/22 91/435
7,090,311 B2 * 8/2006 Yang ..... F16K 31/0689 251/129.02
7,137,400 B2 * 11/2006 Bevers ..... G01F 25/003 137/1
7,194,821 B2 * 3/2007 Edamura ..... G05D 16/2066 118/724
7,798,167 B2 * 9/2010 Ohmi ..... G05D 16/208 137/487.5
7,841,360 B2 * 11/2010 Bruck ..... F15B 13/024 137/493
2006/0054225 A1 * 3/2006 Hillesheim ..... G05D 16/2093 137/625.64
2007/0240769 A1 * 10/2007 Suzuki ..... G05D 7/0635 137/487.5
2010/0227480 A1 * 9/2010 Van De Kerkhof ..... G06D 16/2066 438/795

* cited by examiner

VALVE FOR VALVE ASSEMBLY

FIELD OF THE INVENTION

The invention relates to a valve for a valve assembly for regulating the pressure of a fluid conducted in a hydraulic system for supplying pressure to at least one hydraulic consumer. The valve comprises a pilot control stage and a main control stage for the at least partial clearing or blocking of a fluid path from a supply connection to an outflow connection. A relief stage for releasing the pressure of a fluid chamber is disposed between the pilot control stage and the main control stage. The relief stage compares the load pressure present on a load connection associated with the at least one hydraulic consumer with the outflow pressure at the outflow connection and clears the pressure relief when both pressures are close to one another or equal.

BACKGROUND OF THE INVENTION

Such a valve is known, for example from WO 2011/045063 A1, and is used to adapt the transported fluid current and the supply pressure to the requirement of the at least one hydraulic consumer. The load pressure, in the case of several hydraulic consumers the highest load pressure, is reported back to the valve via a hydraulic load sensing system and is taken into consideration during the regulation of the pressure in such a manner that given a load pressure close to or equal to the outflow pressure, a pressureless circulation, is adjusted via the relief stage. In as far as supply pressure is required by the hydraulic consumer and the load pressure rises in a corresponding manner, the relief stage is closed again and the pilot control stage and the main control stage assume their particular control position. In this manner the power loss in the hydraulic system can be reduced for supplying pressure to the at least one hydraulic consumer.

SUMMARY OF THE INVENTION

The present invention addresses the problem of simplifying the construction of the valve and making the valve accessible for other functions.

This problem is basically solved by a valve where a relief stage can be directly connected to a load connection and loaded with loading pressure. The transfer of the loading pressure to the relief stage as well as the pressure relief, are integrated in the valve. The fluid chamber can be realized with a few pressure connections and fluid connections that can be constructed in a simple manner. The valve advantageously comprises a valve housing with at least one connection line from the load connection to the relief stage and constructed in the housing, preferably as a bore. The load pressure present on the load connection can be guided directly, i.e., without passing through or flowing through other fluid chambers, to the relief stage via the connection line. Delays or influences possibly associated with other fluid chambers during the operation of the valve of the invention are avoided.

An especially compact construction of the valve is achieved if at least one of the stages comprises a valve piston that is shiftably disposed in a particular piston chamber in the valve housing and is preferably pre-tensioned. The piston chamber associated with the relief stage is loaded on the one end by the load pressure, which is typically present in a load sensing line, and on the other end by the outflow pressure. The relief stage can be constructed as a slide valve or a seat valve. The valve piston and/or the valve element are disposed and pre-tensioned in such a manner that a fluid outflow can be cleared from the fluid chamber to its pressure relief at no or only a low load pressure.

Advantageously, the pump pressure can be transmitted via the main control stage, preferably via a passage bore formed in the appropriate valve piston, to the fluid chamber. The fluid chamber is connected in a fluid-conducting manner to the pressure relief controllable by the relief stage. The relief stage assumes a position that clears the pressure relief of the fluid chamber or a blocking position according to the ratio between the two pressures, the load pressure and the outflow pressure, present on the relief stage.

The fluid chamber can be subdivided into a first partial chamber associated with the pilot control stage and a second partial chamber associated with the main control stage. A throttle is preferably disposed between both partial chambers. A throttle disposed between the second partial chamber and the first partial chamber of the fluid chamber can therefore serve as a damping member for the relief stage. In a preferred embodiment of the invention, the relief stage controls a connection from the fluid chamber, in particular from the second partial chamber, to a relief line associated with the outflow connection.

Advantageously, the pilot control stage and/or the main control stage can be loaded with loading pressure. A connection line from the pilot control stage to the relief line is especially preferably provided in a fluid-conducting manner. A pressure relief of a corresponding piston chamber of the pilot control stage can take place via the connection line. This connection line can extend from the second piston chamber to the relief line in the valve housing.

If another connection line is provided from the fluid chamber, in particular from the first partial chamber, to the load connection, another throttle is preferably arranged in the other connection line. A desired pressure change between the fluid chamber and the load connection can be adjusted by the other throttle. Fluid, such as hydraulic oil, can flow off at the load connection via the other connection line from the main control stage to the load connection so that the valve in accordance with the invention can regulate a corresponding load pressure given a connection of the load connection to a hydraulic consumer. In this preferred embodiment of the invention, the relief stage clears a load sensing line to the load tap in at least one hydraulic consumer.

Instead of an integrated construction of pilot control stage, main control stage and relief stage, a decentralized individual disposition of the cited stages to a valve in accordance with the invention is also possible. The relief stage can be disposed, for example, in a parallel disposition to the pilot control stage and the main control stage between a pump and a container for fluid. The relief stage can be directly pre-controlled. However, the relief stage can also be constructed as an electrically actuatable 2/2-way valve that can be controlled, for example, by a control- and/or regulating device processing the signals of a pressure sensor.

The invention furthermore comprises a valve assembly for regulating the pressure of a fluid conducted in a hydraulic system for supplying pressure to at least one hydraulic consumer, with at least one valve in accordance with the invention.

The previously cited features and the ones cited below can be realized in accordance with the invention individually or in any combinations with each other.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure and schematic and not to scale.

DETAILED DESCRIPTION OF THE INVENTION

Figure 1:
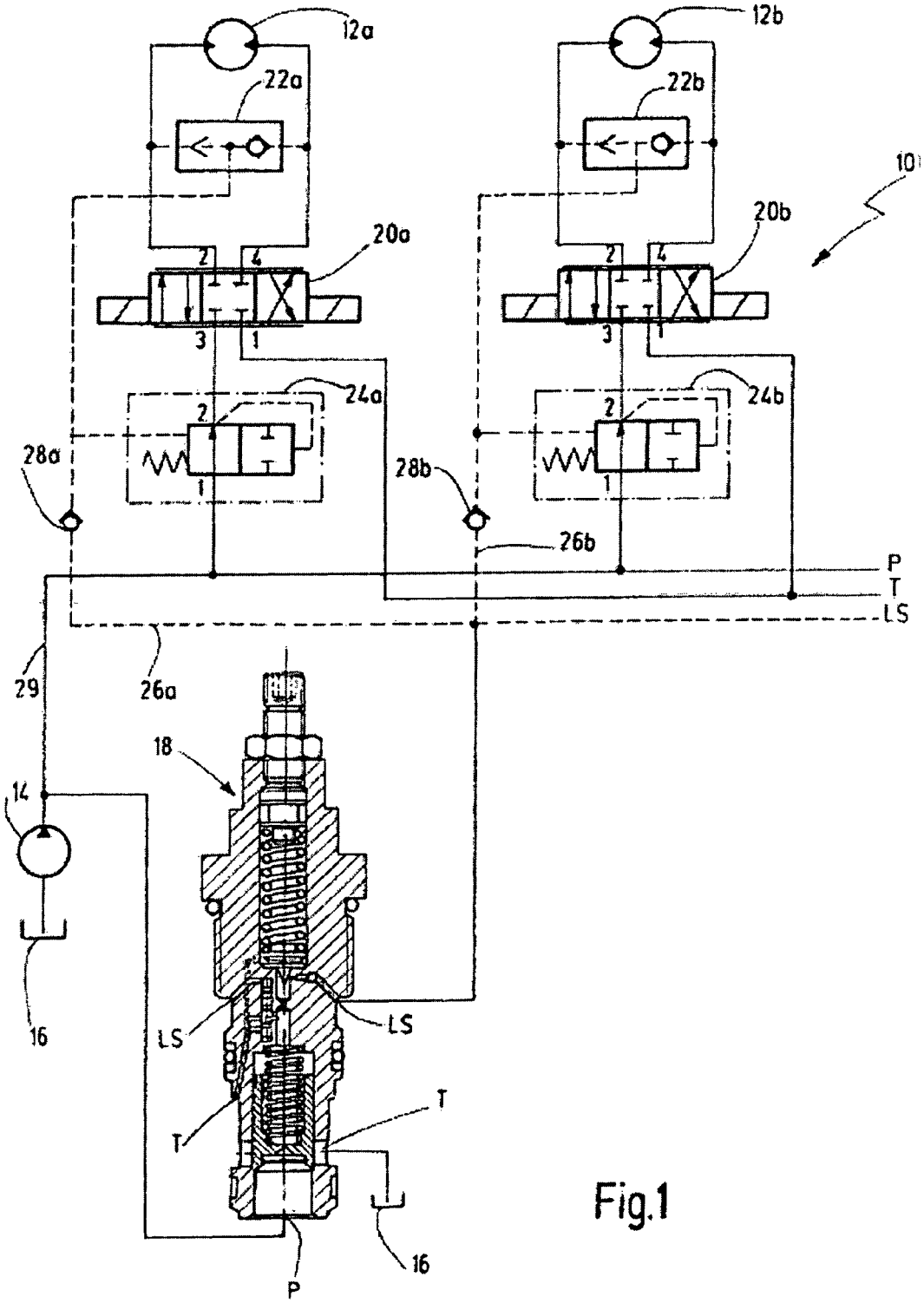
FIG. 1 is a side view in section of a valve for regulating the pressure of a fluid, with the valve located in a hydraulic system for supplying pressure to two hydraulic consumers, according to an exemplary embodiment of the invention.

FIG. 1 shows a valve assembly 10 with a closed hydraulic circuit for supplying two hydraulic consumers 12*a*, 12*b* with fluid. Fluid is transported by a pump 14 constructed as a constant pump from a reservoir 16 to the hydraulic consumers 12*a*, 12*b* that are each constructed as a hydro-motor with two possible directions of flow. The hydraulic circuit including the pump 14 and the hydraulic consumers 12*a*, 12*b* is closed by a valve 18 in accordance with the invention. The hydraulic consumers 12*a*, 12*b* are regulated by electrically actuatable 4/3-way valves 20*a*, 20*b*, respectively. The load pressure present on the particular hydraulic consumer 12*a*, 12*b* is reported to a load sensing (LS) line 26*a*, 26*b* by a changeover valve 22*a*, 22*b*. This valve control is preceded by a 2/2-way valve 24*a*, 24*b* with a pressure-limiting function in the open switching position.

To operate the hydraulic consumers 12*a*, 12*b* at a programmable speed, the volume flow of the fluid transported by the pump 14 is regulated by the valve 18. This combination of a constant pump with the valve 18 for pressure regulation is an economical alternative to an adjusting pump. A nonreturn valve 28*a*, 28*b* is connected into the hydraulic circuit in the load sensing lines 26*a*, 26*b*, provided for tapping off the load in the particular hydraulic consumer 12*a*, 12*b*, in front of each changeover valve 22*a*, 22*b*. Each nonreturn valve has the same opening pressure and opens in the direction of the valve 18, more precisely in the direction of its load-sensing connection LS. This parallel connection of the load sensing lines 26*a*, 26 regarding the valve 18 allows a comparison of the two load pressures on the hydraulic consumers 12*a*, 12*b*. The greater of the two load pressures is considered for the pressure regulating on the valve 18.

The valve 18 is connected or can be connected by its load connection LS to the load sensing lines 26*a*, 26*b*. The valve 18 is connected or can be connected by its supply connection P to the supply line 29 supplied with pressure by the pump 14 and extending to the hydraulic consumers 12*a*, 12*b*, as well as by its outflow connection T to a reservoir 16 that can be a pressure agent container or a tank. The valve 18 is an independent unit that can be manipulated and can be inserted as needed into the valve assembly 10.

The design of the valve 18 can be gathered from the FIGS. 2*a*-2*d* that show the valve 18 in section with a cartridge-like valve housing 30 designed as a screw-in valve. A first piston chamber 32, a fluid chamber 34, which is subdivided into a first partial chamber 35*b* and a second partial chamber 35*a* and a second piston chamber 36 are constructed in the valve housing 30 coaxially to the axis of rotation R. A main control stage or piston 38 is constructed in the first piston chamber 32 by valve pistons that can shift in the particular piston chamber 32, 36 parallel to the axis of rotation R. A pilot control stage or piston 48 is constructed in the second piston chamber 36. The particular valve pistons 38, 38 are pre-tensioned by a first spring element 40 and a second spring element 50, respectively.

A third piston chamber 52 constructed in the valve housing 30 is parallel to the fluid chamber 34 and connected to it, more precisely to the second partial chamber 35*a*, by a connection 60. A valve piston of the relief stage 54 is shiftably disposed in the third piston chamber 52 and pre-tensioned by a third spring element 56. The third piston chamber 52 is connected by a connection line 61 to the load connection LS and by a relief line 62 to the outflow connection T, so that the load pressure and the outflow pressure are present on the relief stage 54. The relief stage 54 compares the load pressure to the outflow pressure and opens, as soon as the load pressure on the load connection LS is close to or equal to the outflow pressure on the outflow connection T, a bypass for relieving the pressure of the fluid chamber 34.

In the exemplary embodiment shown, the bypass is realized by a connection 60 between the fluid chamber 34 and the relief line 62 extending to the outflow connection T. The connection 60 can be cleared by the valve piston of the relief stage 54, as is shown in the FIGS. 2*b* and 2*c*), or closed, as shown in the FIGS. 2*a* and 2*d*. In the clearing position of the valve piston of the relief stage 54, an annular groove 58 formed in the valve piston is disposed in the crossing area between the third piston chamber 52 directed parallel to the axis of rotation R and the connection 60 extending transversely to the third piston chamber 52 and to the axis of rotation R. In the open position, cf. FIG. 3, fluid can flow off from the fluid chamber 34 via the connection 60 past the annular groove 58 of the valve piston of the relief stage 54 via the relief line 62 to the outflow connection T.

Figure 2A:
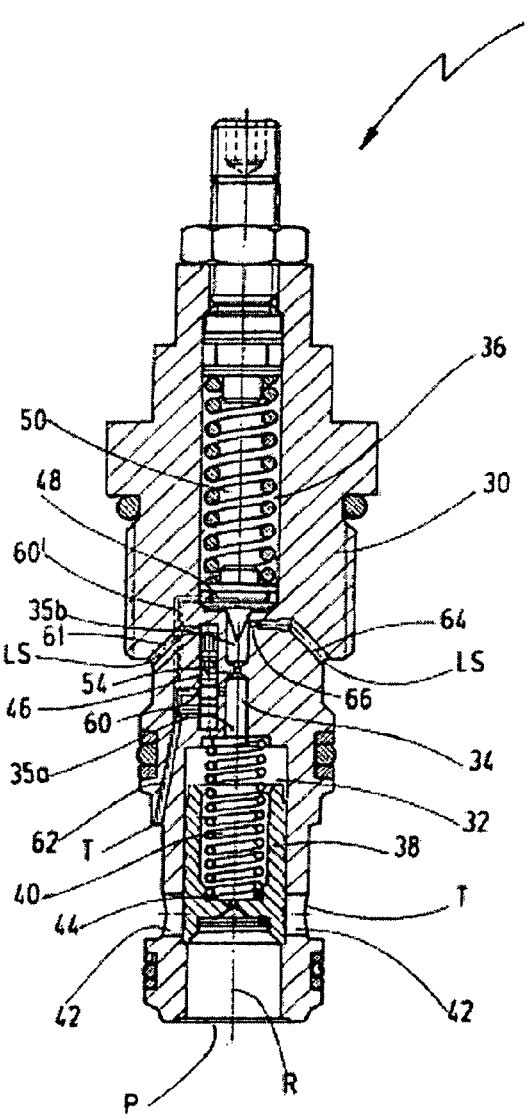
FIG. 2*a*-2*d* are side views in section of the valve of FIG. 1 in different switching positions.

In the view of FIG. 2*a*, the valve piston associated with the pilot control stage 48 and loaded by the second spring element 50 rests on a valve seat formed on the appropriate end of the fluid chamber 54 or of the first partial chamber 35*b*. The valve piston associated with the main control stage 38 and loaded by the first spring element 40 is disposed in the valve housing 30 in such a manner that a fluid path 40 is blocked by the supply connection P via radial passage openings 42 formed in a section of the valve housing 30. The load pressure present on the load connection LS exceeds the outflow pressure or tank pressure present on the outflow connection T so that the third spring element 56 loading the valve piston of the relief stage 54 is compressed and the bypass to the pressure relief, here the connection 60, is blocked, in other words, closed.

Figure 2B:
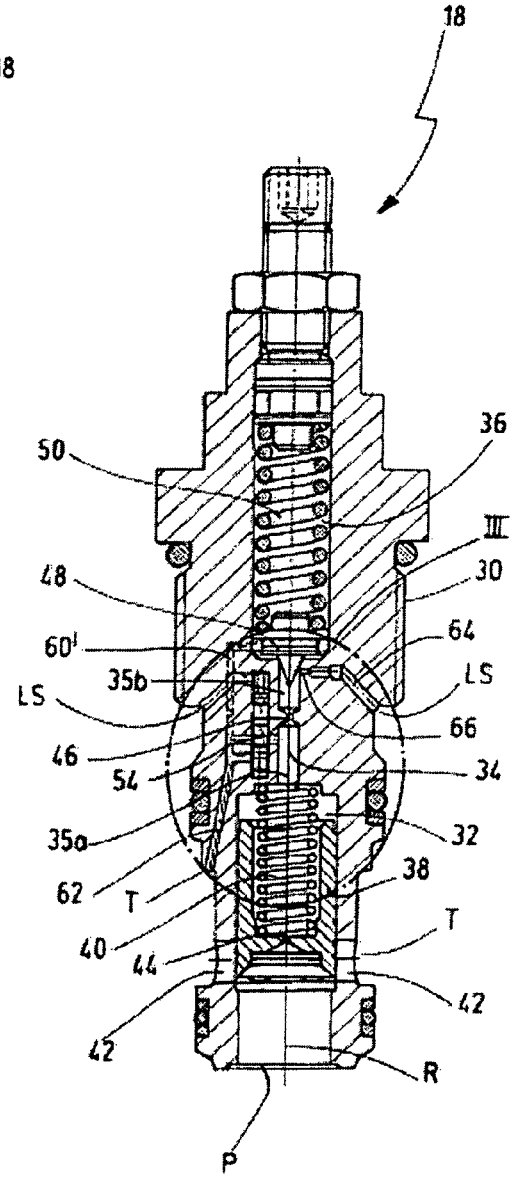
Figure 2D:
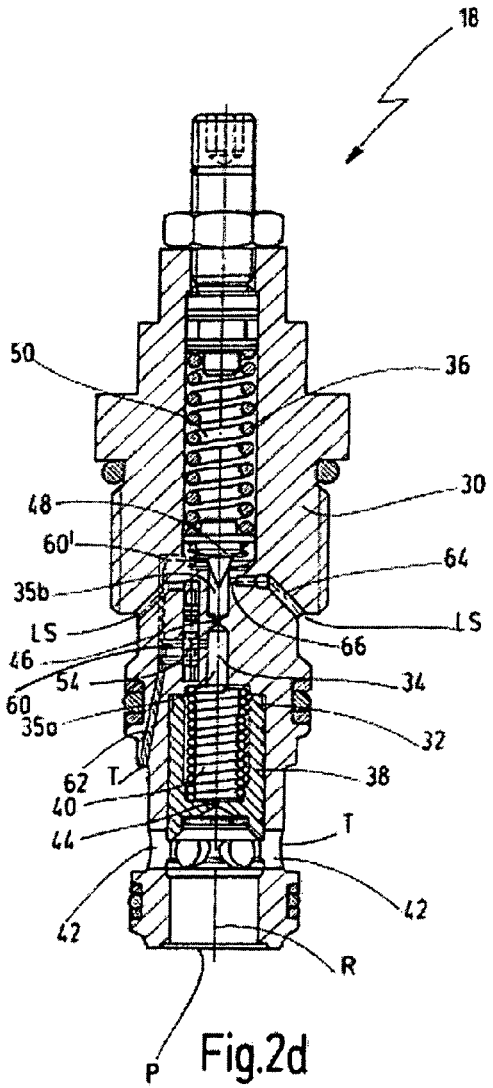
Figure 2C:
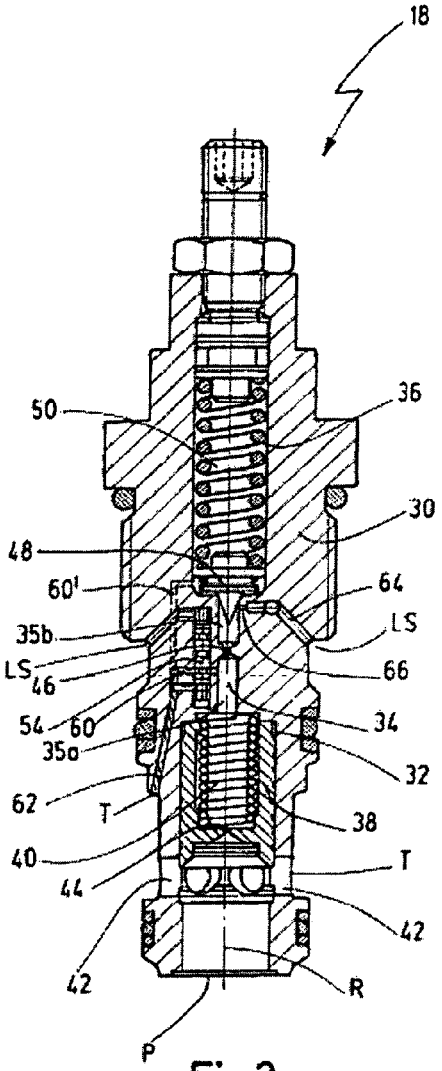

As soon as the load pressure drops and approaches the outflow pressure, the valve piston moves into the position shown in the FIGS. 2*b* and 2*c*, clearing the connection 60. A fluid path from a supply connection P or pump connection to the outflow connection T or tank connection is cleared corresponding to the pressure drop in the fluid chamber 34 accompanying the pressure relief. While the fluid path in FIG. 2*b* is only partially cleared, the valve piston of the main control stage 38 is located in the view of FIG. 2*c* in its position that maximally clears the fluid path and rests on a valve seat formed on the valve housing 30. Fluid can also flow from this fluid chamber to the outflow connection T via another connection 60' constructed as a bore and that extends from the second piston chamber 36 to the relief line 62 in the valve housing 60.

The fluid pressure on the fluid chamber 34 present on the pump side on the main control stage 38 can be transferred between the main control stage 38 and the pilot control stage 48 via a passage bore 44 constructed centrally, that is, along the radial axis R, in the valve piston of the main control stage 38. As soon as the load pressure rises again and exceeds the outflow, the relief stage 54 and in a corresponding manner the connection 60 from the fluid chamber 34 to the outflow connection T is closed and the pilot control stage 48 is opened by the rising fluid pressure in the fluid chamber 34, as shown in FIG. 2*d*. In the following step, the valve position or switching position in FIG. 2*a*, the blocking of the fluid path from the supply connection P to the outflow connection T is adjusted again.

Figure 3:
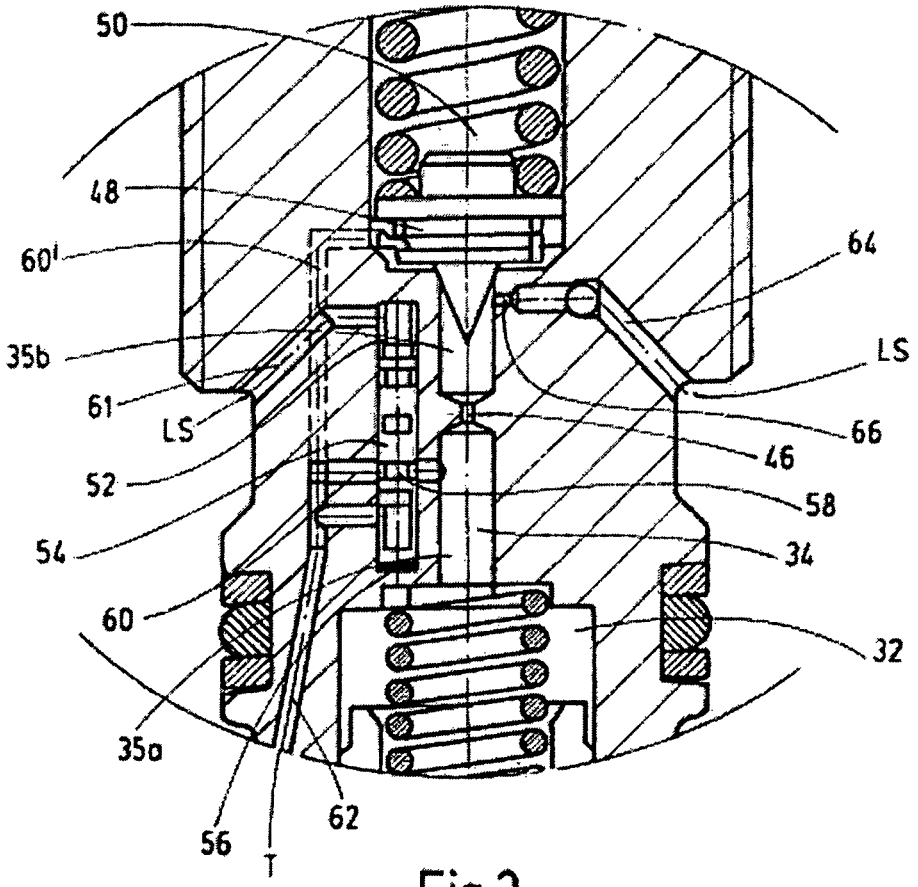
FIG. 3 is an enlarged, partial side view in section of the valve of a section of FIG. 2*b*.

As FIG. 3 in particular shows, another connection line 64 extends from the load connection LS to the fluid chamber 34, more precisely to the first partial chamber 35*b*. A pressure stage is set in the other connection line 64 by another throttle 66. The valve 18 offers as another function, in other words, the option of an outflow of fluid such as hydraulic oil via the other connection line 64. Upon the connection of a hydraulic consumer 12*a*, 12*b* on the corresponding load connection LS, the valve 18 regulates the corresponding load pressure, which can be reduced as required by the relief stage 54.

While one embodiment has been chosen to illustrate the invention, it will be understood by those skilled in the art that various changes and modifications can be made therein without departing from the scope of the invention as defined in the claims.

The invention claimed is:

1. A valve for a valve assembly for regulating fluid pressure conducted in a hydraulic system for supplying pressure to a hydraulic consumer, the valve comprising a valve housing having a supply connection, an outflow connection and a load connection associated with the hydraulic consumer;

a pilot control stage with a second piston chamber and a main control stage with a first piston chamber in said valve housing at least partially clearing and blocking a fluid path from said supply connection to said outflow connection;

a fluid chamber disposed between said pilot control stage and said main control stage;

a relief stage releasing pressure in said fluid chamber, comparing a load pressure present at said load connection with outflow pressure at said outflow connection and clearing pressure relief in said fluid chamber when the load pressure and the outflow pressure are substantially equal to one another, said relief stage being directly connected to said load connection and being loadable with the load pressure; and a first connection line in said valve housing extending and providing fluid communication between said second piston chamber of said pilot control stage and a relief line, said relief line being connected to said outflow connection.

2. A valve according to claim 1 wherein a second connection line extends in said valve housing from said load connection to said relief stage and comprises a bore.

3. A valve according to claim 1 wherein each of said pilot control stage and said main control stage comprises a valve piston movable in the respective piston chamber and being pre-tensioned.

4. A valve according to claim 3 wherein a passage bore in said valve piston of said main control stage transmits pump pressure via said main control stage to said fluid chamber.

5. A valve according to claim 1 wherein said fluid chamber is subdivided into a first partial chamber connected to said pilot control stage and a second partial chamber connected to said main control stage; and a throttle orifice is disposed between and connects said first and second partial chambers.

6. A valve according to claim 5 wherein said relief stage controls a connection from second partial chamber to said relief line connected to said outflow connection.

7. A valve according to claim 1 wherein said pilot control stage and said main control stage are loaded with the load pressure.

8. A valve according to claim 5 wherein a third connection line in said valve housing extends from said first partial chamber to said load connection.

9. A valve according to claim 8 wherein a throttle is in said third connection line.

10. A valve according to claim 5 wherein said throttle orifice is disposed at least one of in front of or behind outflow to a throttle position in a valve piston of said relief stage;

said throttle position is at least one of in front of or behind valve pistons of said pilot control stage and said main control stage.

11. A valve according to claim 10 wherein said throttle position comprises an annular groove in a valve piston of said pressure relief stage.

12. A hydraulic system, comprising:

a hydraulic consumer;

a pump in fluid communication with said consumer; and a pressure regulating valve in fluid communication with said hydraulic consumer and said pump, said pressure regulating valve regulating fluid pressure conducted by said pump to said hydraulic consumer, said pressure regulating valve including a valve housing having a supply connection, an outflow connection and a load connection with a second piston chamber connected with the hydraulic consumer;

a pilot control stage with second piston chamber and a main control stage with a first piston chamber in said valve housing at least partially clearing and blocking a fluid path from said supply connection to said outflow connection;

a fluid chamber disposed between said pilot control stage and said main control stage;

a relief stage releasing pressure in said fluid chamber, comparing a load pressure present at said load connection with outflow pressure at said outflow connection and clearing pressure relief in said fluid chamber when the load pressure and the outflow pressure are substantially equal to one another, said relief stage being directly connected to said load connection and being loadable with the load pressure; and a first connection line in said valve housing extending and providing fluid communication between said second piston chamber of said pilot control stage and a relief line, said relief line being connected to said outflow connection.

13. A hydraulic system according to claim 12 wherein a second connection line extends in said valve housing from said load connection to said relief stage and comprises a bore.

14. A hydraulic system according to claim 9 wherein each of said pilot control stage and said main control stage comprises a valve piston movable in the respective piston chamber and being pre-tensioned.

15. A valve according to claim 14 wherein a passage bore in said valve piston of said main control stage transmits pump pressure via said main control stage to said fluid chamber.

16. A hydraulic system according to claim 12 wherein said fluid chamber is subdivided into a first partial chamber connected to said pilot control stage and a second partial chamber connected to said main control stage; and a throttle orifice is disposed between and connects said first and second partial chambers.

17. A hydraulic system according to claim 16 wherein said relief stage controls a connection from second partial chamber to said relief line connected to said outflow connection.

18. A hydraulic system according to claim 12 wherein said pilot control stage and said main control stage are loaded with the load pressure.

19. A hydraulic system according to claim 16 wherein a third connection line in said valve housing extends from said first partial chamber to said load connection.

20. A hydraulic system according to claim 19 wherein a throttle is in said third connection line.

21. A hydraulic system according to claim 16 wherein said throttle orifice is disposed at least one of in front of or behind outflow to a throttle position in a valve piston of said relief stage;

said throttle position is at least one of in front of or behind valve pistons of said pilot control stage and said main control stage.

22. A hydraulic system according to claim 21 wherein said throttle position comprises an annular groove in a valve piston of said pressure relief stage.

* * * * *